United States Patent [19]

Imai et al.

[11] Patent Number: 4,866,887

[45] Date of Patent: Sep. 19, 1989

[54] METHOD OF TRUING GRINDING WHEEL

[75] Inventors: Tomoyasu Imai, Kariya; Ryouhei Mukai, Toyoake; Toshihiro Tsutsui, Nishio, all of Japan

[73] Assignee: Toyoda Koki Kabushiki Kaisha, Kariya, Japan

[21] Appl. No.: 129,759

[22] Filed: Dec. 7, 1987

[30] Foreign Application Priority Data

Dec. 10, 1986 [JP] Japan ..... 61-292430

[51] Int. Cl.[4] ..... B24B 53/02

[52] U.S. Cl. ..... 51/325; 51/5 D; 125/11 R

[58] Field of Search ..... 51/325, 5 D, 165.87; 125/11 R, 11 NT, 11 M, 11 CD, 11 CW, 11 ST, 11 DF, 11 H

[56] References Cited

U.S. PATENT DOCUMENTS

| | | | |
|---|---|---|---|
| 4,266,374 | 5/1981 | Asano et al. | 51/165.87 |
| 4,530,187 | 7/1985 | Koide et al. | 51/165.87 |
| 4,713,914 | 12/1987 | Oshima | 51/5 D |
| 4,736,326 | 4/1988 | Akabane | 51/165.87 |

FOREIGN PATENT DOCUMENTS

| | | | |
|---|---|---|---|
| 55-45344 | 11/1980 | Japan . | |
| 265270 | 11/1986 | Japan | 125/11 H |
| 1036509 | 8/1983 | U.S.S.R. | 125/11 R |

OTHER PUBLICATIONS

*Industrial Diamond Review*, vol. 14, "Quality the Key to Economical Use of Diamond Abrasives", C. R. Meyer, Oct. 1954.

*Microtechnic*, vol. 7, No. 5, Dr. Pahlitzch, "Influence of Dressing Conditions on Grinding", May, 1954.

*Primary Examiner*—Robert P. Olszewski

*Assistant Examiner*—Blynn Shideler

*Attorney, Agent, or Firm*—Oblon, Spivak, McClelland, Maier & Neustadt

[57] ABSTRACT

A grinding wheel which is formed from super hard abrasive grains is trued by traverse-feeding a truing tool a plurality of times (n). Among the (n) traverse feeds of the truing tool, every traverse feed except for the final (i.e., from the first to the (n−1)th traverse feed) is carried out with an infeed which is set at a relatively small value in order to remove any deflection of the grinding wheel. In the final traverse feed, the infeed of the truing tool is set at a relatively large value in order to form an excellent cutting edge on the grinding wheel. Accordingly, any deflection of the grinding wheel is removed by a plurality of traverse feeds of the truing tool carried out with a relatively small infeed, and a cutting face having an excellent cutting ability is formed on the grinding wheel by the final traverse feed carried out with a relatively large infeed.

5 Claims, 4 Drawing Sheets

METHOD OF TRUING GRINDING WHEEL

BACKGROUND OF THE INVENTION

1. Field of the Invention

The present invention relates to a method of truing a grinding wheel formed from super hard abrasive grains which is used in a grinding apparatus.

2. Discussion of the Prior Art

Truing of a grinding wheel formed from super hard abrasive grains, such as a CBN (Cubic Boron Nitride) grinding wheel, is effected by traverse-feeding a rotary truing tool or a pyramidal single- or multiple-diamond truing tool along the cutting face of the grinding wheel.

In the case of a grinding wheel formed from super hard abrasive grains such as a CBN grinding wheel, the level of grinding force of the grinding wheel immediately after it has been trued is greatly different from that immediately before the grinding wheel was trued. The level of grinding force of the grinding wheel immediately after truing is relatively large, but as the grinding wheel is used to grind workpieces, that is, as the stock removal increases, the level of grinding force decreases and eventually reaches a steady state. More specifically, immediately after truing, the amount by which abrasive grains project from the bond on the outer peripheral surface of the grinding wheel is relatively small, and the cutting edge defined by the distal ends of abrasive grains is dull. For these reasons, the cutting ability of the grinding wheel is inferior and the level of grinding force is therefore high. On the other hand, as the grinding operation progresses, chips generated as a result of the grinding remove the bond between abrasive grains to define chip pockets, and the cutting edge defined by the distal ends of abrasive grains is sharpened as a result of the grinding operation, resulting in a lowering in the level of grinding force.

Accordingly, it is necessary to lower the level of grinding force immediately after the grinding wheel has been trued. It may be possible to meet this requirement by increasing the infeed of the truing tool with respect to the grinding wheel.

The above-described solution to the problem suffers, however, from the following disadvantages. As the infeed of the truing tool is increased, a sharper cutting edge is formed on the grinding wheel and therefore the level of grinding force may be decreased as shown by the solid line in FIG. 5. However, if the grinding wheel has a deflection, the deflection cannot be removed even by carrying out truing many times with a large infeed. Instead, as the infeed of the truing tool is increased, the deflection of the grinding wheel grows as shown by the chain line in FIG. 5. This is attributed to the fact that, as the infeed of the truing tool is increased, the frequency by which the cutting edge of the truing tool becomes worn increases and the truing tool is undesirably moved from its cutting position due to the resistance occurring during truing.

SUMMARY OF THE INVENTION

Accordingly, it is a primary object of the present invention to provide a method of truing a grinding wheel formed from super hard abrasive grains which enables a lowering in the level of grinding force of the grinding wheel immediately after it has been trued and which causes no increase in the deflection of the grinding wheel.

In brief, in the truing method according to the present invention, a grinding wheel which is formed from super hard abrasive grains is trued by traverse-feeding a truing tool a plurality of times (n). Among the (n) traverse feeds of the truing tool, every traverse feed except for the final (i.e., from the first to the (n−1)th traverse feed) is carried out with an infeed which is set at a relatively small value in order to remove any deflection of the grinding wheel. In the final traverse feed, the infeed of the truing tool is set at a relatively large value in order to form an excellent cutting edge on the grinding wheel.

According to the method of the present invention, any deflection of the grinding wheel is removed by a plurality of traverse feeds of the truing tool which are carried out with a relatively small infeed, and a cutting face having an excellent cutting ability is formed on the grinding wheel by the final traverse feed carried out with a relatively large infeed.

BRIEF DESCRIPTION OF THE ACCOMPANYING DRAWINGS

The above and other objects, features and advantages of the present invention will become apparent from the following description of the preferred embodiments thereof, taken in conjunction with the accompanying drawings, in which like reference numerals denote like members, and in which.

DETAILED DESCRIPTION OF THE PREFERRED EMBODIMENTS

Figure 1:
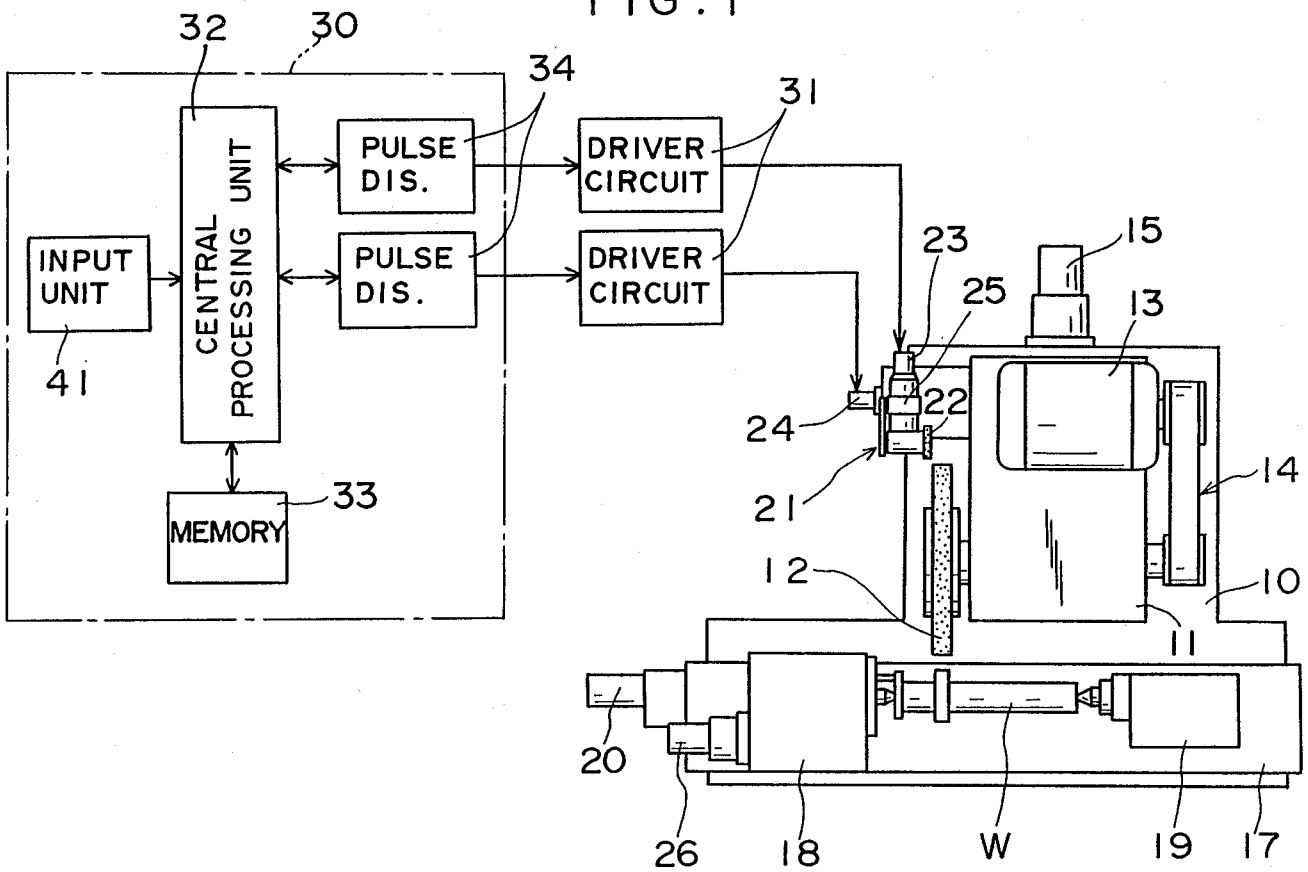
FIG. 1 is a schematic plan view of a grinding apparatus for practicing the truing method according to the present invention, the figure also showing a block diagram of a numerical controller for the grinding apparatus.

Referring now specific reference to FIG. 1, which shows a numerically-controlled grinding apparatus for practicing the truing method according to the present invention, the apparatus includes a bed 10 which has a wheel spindle stock 11 mounted thereon in such a manner that the wheel spindle stock 11 is able to be advanced and retracted. The wheel spindle stock 11 rotatably supports a grinding wheel 12 which is formed from super hard abrasive grains such as diamond or CBN grains. The grinding wheel 12 is activated to rotate through a belt transmission gear 14 by the operation of a wheel driving motor 13 which is installed on the wheel spindle stock 11. It should be noted that the wheel spindle stock 11 is advanced and retracted by the operation of a feed mechanism which has a servo motor 15 as a drive source.

A table 17 is mounted on the bed 10, the table 17 being activated by a servo motor 20 so as to move sideward as viewed in FIG. 1. A headstock 18 and a tailstock 19 are mounted on the table 17 to support a workpiece W therebetween. The workpiece W is rotated by the operation of a spindle driving motor 26 which is installed on the headstock 18.

The reference numeral 21 denotes a truing device which is secured to one side of the wheel spindle stock 11. The truing device 21 is activated to true the grinding wheel 12 every time a predetermined number of workpieces W have been ground with the grinding wheel 12.

The truing device 21 includes a motor 25 for rotating a rotary truing tool 22 and further includes a truing feed mechanism which consists of a first servo motor 23 for applying infeed to the truing tool 22 in the radial direction of the grinding wheel 12 and a second servo motor 24 for applying traverse feed to the truing tool 22 in the axial direction of the grinding wheel 12.

The reference numeral 30 denotes a numerical controller for controlling the first and second servomotors 23, 24. The numerical controller 30 consists essentially of a central processing unit 32, memory 33, a pulse distributors 34 and an input unit 41. Driver circuits 31 for the first and second servomotors 23, 24 control infeed and traverse feed of the truing device 21 in response to command pulses delivered from the pulse distributors 34.

Figure 2:
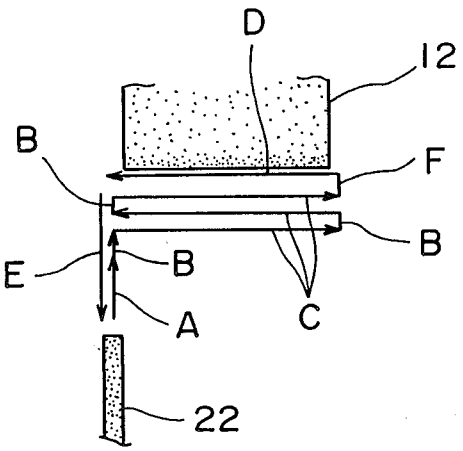
FIG. 2 shows the operation of the apparatus conducted in accordance with the truing method of the present invention.
Figure 5:
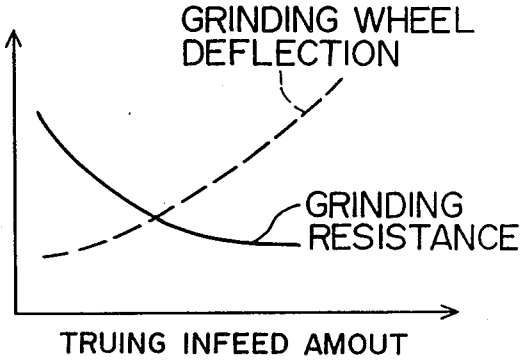
FIG. 5 is a graph showing the relationship of the changes in deflection and grinding force of the grinding wheel with the increase in infeed of the truing tool.

In the truing method according to the present invention, the number of times of traverse feed which are to be applied to the truing device 22 is set so as to be a plural number (n). Among the (n) traverse feeds, every traverse feed except for the final (i.e., from the first to the (n−1)th traverse feed) is carried out with an infeed for the truing device 22 which is set so as to be relatively small. In the final traverse feed, the infeed for the truing device 22 is set so as to be relatively large. Thus, truing of the grinding wheel 12 is carried out with the infeed being varied as described above. This control operation will next be explained in more detail with reference to FIGS. 2 to 4.

Figure 3:
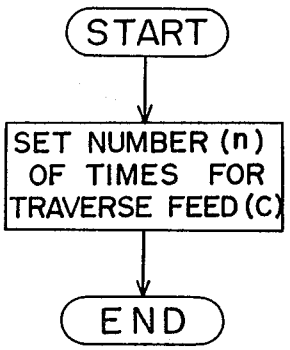
FIGS. 3 and 4 are flowcharts showing the processes executed by the numerical controller shown in FIG. 1.
Figure 4:
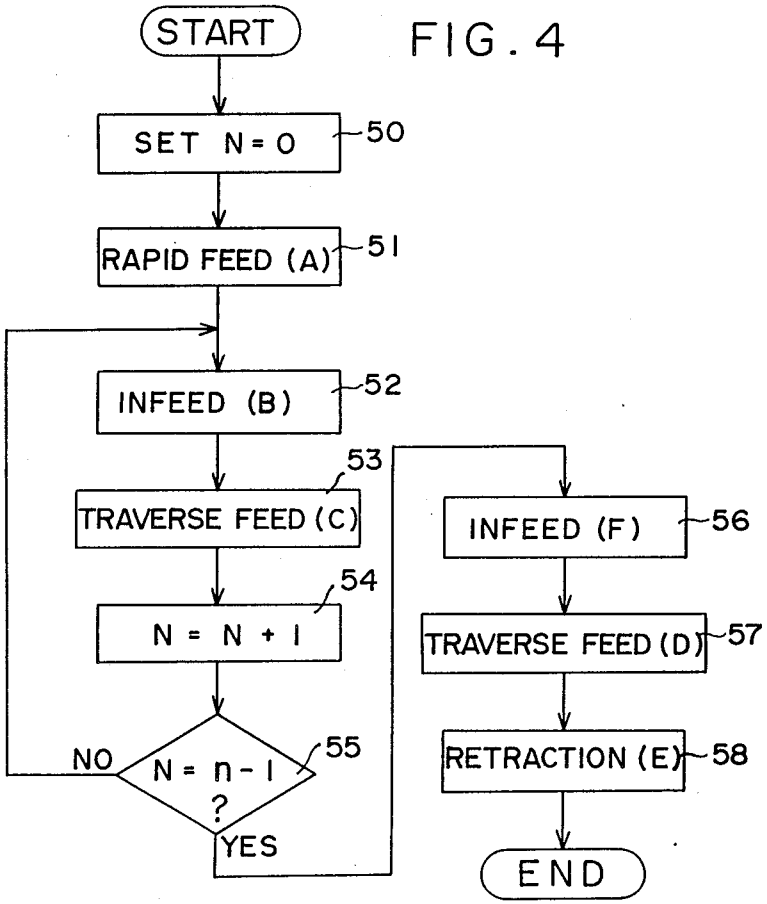

First, a number (n) of times of traverse feed to be effected (i.e., a number of times of truing) is set through the input unit 41 and stored in the memory 33 as shown in FIG. 3. Then, the truing tool 22 is rotated and rapidly fed so as to advance toward the grinding wheel 12 by a predetermined amount A (Step 51 in FIG. 4). The truing tool 22 is further fed toward the grinding wheel 12 with a relatively small infeed B (Step 52) and then fed axially of the grinding wheel 12 with a predetermined traverse feed (Step 53), thereby truing the grinding wheel 12 over the entire width of the cutting face thereof.

Prior to the start of every traverse feed except for the final in the set number (n) of times of traverse feed, the truing tool 22 is fed toward the grinding wheel 12 by an infeed B (Step 52). By carrying out truing several times with this relatively small infeed B, any deflection of the grinding wheel 12 is removed. Subsequently, the truing tool 22 is given a relatively large infeed F (Step 56) and then the final traverse feed D is carried out (Step 57). In this way, the distal ends of abrasive grains are broken down to a substantial extent and thus a sharp cutting face is formed. Thereafter, the truing device 22 is retracted by a predetermined amount E (Step 58), thus completing truing of one grinding wheel. For example, the above-described small infeed B is set at 2.5 microns, and the large infeed F at 5 microns.

Figure 6:
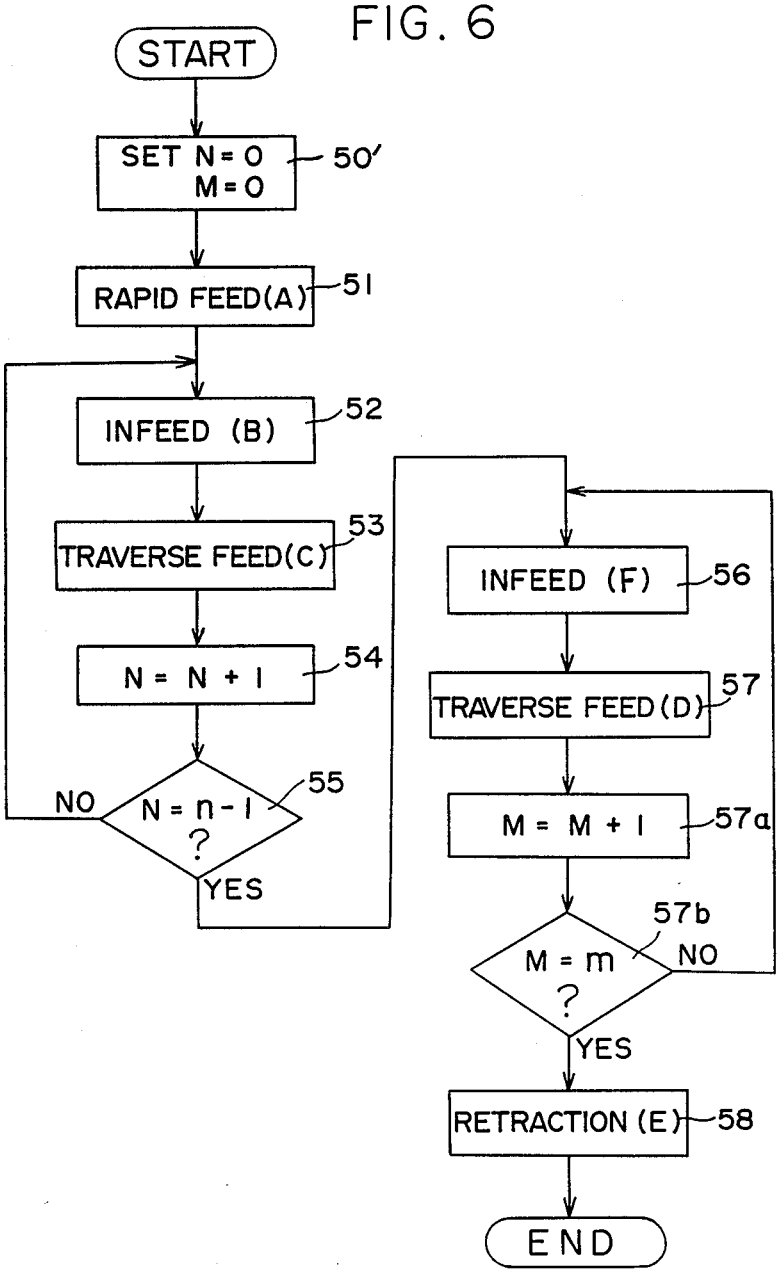
FIG. 6 is a flowchart according to another embodiment of the present invention which may be employed in place of the flowchart shown in FIG. 4.

In another embodiment in which the central processing unit 32 operates according to the flowchart shown in FIG. 6, the traverse feed with a relatively large infeed F is executed several times, preferably twice, (i.e., m=2 in Step 57*b*).

In the above-described embodiment, the number (n) of times of traverse feed with a relatively small infeed B is set within the range of 2 to 10 times. The number of times of this traverse feed greatly depends, for example, on the depth of a local wear in the cutting face of the grinding wheel 12 before it is subjected to truing, that is, after it has been used for a series of grinding operations. For instance, after a plunge grinding in which one or two edge portions of the cutting face of he grinding wheel 12 are not used in a series of grinding operations, the portion of the cutting face except for the one or two edge portions has become worn to a substantial extent. Therefore, in such a case, the number (n) of times of traverse feed is set at a relatively large number. On the other hand, the purpose of the traverse feed with a relatively large infeed F is to form a cutting edge of abrasive grains and therefore it suffices to carry out the traverse feed once or twice.

It will be obvious that many modifications and variations of the present invention are possible in the light of the foregoing teachings. Accordingly, it should be noted that the present invention may also be practiced in methods other than those described in this literature.

What is claimed is:

1. A method of truing a grinding wheel formed from super hard abrasive grains with a truing tool prior to a grinding operation, said method comprising the sequential steps of:

a first step of feeding said turning tool toward said grinding wheel with a first predetermined infeed and subsequently traverse-feeding said truing tool over the entire width of said grinding wheel;

repeating first step at least once; and a second step of feeding said truing tool toward said grinding wheel with a second predetermined infeed which is larger than said first predetermined infeed and subsequently traverse-feeding said truing tool over the entire width of said grinding wheel.

2. A truing method according to claim 1, wherein said second step is executed only once.

3. A method of truing a rotating grinding wheel formed form: super hard abrasive grains with a truing tool prior to a grinding operation, said method comprising the sequential steps of:

(a) feeding said truing tool toward said gringing wheel with a first predetermined infeed;

(b) traverse-feeding said truing tool over the entire width of said grinding wheel;

(c) repeating said steps (a) and (b) a plurality of times;

(d) feeding said truing tool toward said grinding wheel with a second predetermined infeed which is larger than said first predetermined infeed; and (e) traverse-feeding said truing tool over the entire width of said grinding wheel.

4. A truing method according to claim 3, wherein said steps (d) and (e) are executed one more time.

5. A method of truing a grinding wheel formed form super hard abrasive grains by traverse-feeding a truing tool over the entire width of said grinding wheel a plurality of times (N) prior to a grinding operation, said method comprising the sequential steps of:

setting an infeed for the movement of said truing tool in the radial direction of said grinding wheel at a relatively small value for each of at least two traverse feeds carried out before the number of times of said traverse feed reaches N−n (where n is 1 or 2); and setting said infeed at a relatively large value for at least one traverse feed carried out after the number of times of said traverse feed has reached N−n.

* * * * *